US008750780B2

(12) United States Patent
Izumi et al.

(10) Patent No.: US 8,750,780 B2
(45) Date of Patent: Jun. 10, 2014

(54) PRINTING APPARATUS AND SHEET PROCESSING APPARATUS

(75) Inventors: Masato Izumi, Kawasaki (JP); Tetsuhiro Nitta, Yokohama (JP); Ryosuke Sato, Kawasaki (JP); Kenji Shigeno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 12/949,632

(22) Filed: Nov. 18, 2010

(65) Prior Publication Data

US 2011/0211889 A1 Sep. 1, 2011

(30) Foreign Application Priority Data

Feb. 26, 2010 (JP) ..... 2010-042341

(51) Int. Cl.

| | |
|---|---|
| ***G03G 15/00*** | (2006.01) |
| ***B65H 23/32*** | (2006.01) |
| ***B65H 23/34*** | (2006.01) |
| ***B65H 85/00*** | (2006.01) |
| ***B41J 3/60*** | (2006.01) |

(52) U.S. Cl.

USPC ..... 399/406; 399/401; 399/402; 347/104

(58) Field of Classification Search

USPC ..... 399/406

See application file for complete search history.

(56) References Cited

U.S. PATENT DOCUMENTS

| | | | | | |
|---|---|---|---|---|---|
| 5,572,308 | A * | 11/1996 | Suda et al. | ..... | 399/401 |
| 5,581,290 | A * | 12/1996 | Kuehnle | ..... | 347/115 |
| 6,415,130 | B1 * | 7/2002 | Fujiwara et al. | ..... | 399/401 |
| 2002/0130941 | A1 * | 9/2002 | Tanaami | ..... | 347/104 |
| 2007/0092322 | A1 * | 4/2007 | Tomatsu | ..... | 399/406 |
| 2009/0129839 | A1 * | 5/2009 | Yamazaki et al. | ..... | 399/400 |
| 2009/0190985 | A1 * | 7/2009 | Yamamoto et al. | ..... | 399/406 |

FOREIGN PATENT DOCUMENTS

| | | | | | |
|---|---|---|---|---|---|
| JP | 02122966 | A * | 5/1990 | ..... | B41J 25/308 |
| JP | 04361075 | A * | 12/1992 | ..... | B41J 2/01 |
| JP | 07-081819 | A | 3/1995 | | |
| JP | 08-175733 | A | 7/1996 | | |
| JP | 2000044100 | A * | 2/2000 | ..... | B65H 85/00 |
| JP | 2000351503 | A * | 12/2000 | ..... | B65H 23/038 |
| JP | 2003-291385 | A | 10/2003 | | |
| JP | 2005258251 | A * | 9/2005 | ..... | G03G 15/00 |
| JP | 2007-144960 | A | 6/2007 | | |
| JP | 2008-126530 | A | 6/2008 | | |
| JP | 2008126530 | A * | 6/2008 | | |
| JP | 2009-242008 | A | 10/2009 | | |

* cited by examiner

*Primary Examiner* — Nguyen Ha

(74) *Attorney, Agent, or Firm* — Canon USA, Inc., IP Division

(57) ABSTRACT

A decurling unit regulates a decurling force so as to be smaller when a sheet is returned from a printing unit to a sheet feeding unit than when the sheet is fed from the sheet feeding unit to the printing unit.

9 Claims, 12 Drawing Sheets

PRINTING APPARATUS AND SHEET PROCESSING APPARATUS

BACKGROUND OF THE INVENTION

1. Field of the Invention

The present invention relates to a printing apparatus and a sheet processing apparatus that have a decurling mechanism.

2. Description of the Related Art

Japanese Patent Laid-Open No. 2009-242008 discloses a decurling device that is employed in a printing apparatus and corrects the curl of a rolled long continuous sheet. This device wraps the sheet around a shaft-like correcting member of a decurling unit at a predetermined wrapping angle, thereby exerting a force that corrects the curl (decurling force) on the sheet.

In a printing apparatus, a rolled sheet is generally cut by a cutter after printing, and the unused region of the sheet is returned and wound. Decurling force also acts on the sheet during this return because a region of the sheet within a predetermined distance from the cut edge passes through the decurling unit. In the case where printing is performed again, the sheet is fed to the printing unit again. Also in this case, decurling force acts on the sheet. If decurling force acts on the same region every time the sheet moves back and forth, excessive decurling may curl the sheet in the opposite direction from the original curl. If the sheet that is significantly curled in the opposite direction is supplied to the printing unit, the leading edge of the sheet may come into contact with the print head. If the sheet comes into contact with the print head, unexpected ink may adhere to the sheet, or the print head and the sheet may be damaged.

SUMMARY OF THE INVENTION

The present invention reduces the chance that, in a printing apparatus, when a rolled sheet is fed, the sheet comes into contact with a print head after passing through a decurling unit. The present invention reduces the chance that, in a sheet processing apparatus, when a rolled sheet is fed, the sheet comes into contact with a sheet processing unit after passing through a decurling unit.

In an aspect of the present invention, an apparatus includes a sheet feeding unit configured to feed a sheet, a decurling unit configured to exert a decurling force on the sheet fed from the sheet feeding unit so as to reduce a curl of the fed sheet, and a printing unit configured to perform printing on the sheet passed through the decurling unit. The decurling force is regulated so as to be smaller when the sheet is returned from the printing unit to the sheet feeding unit than when the sheet is fed from the sheet feeding unit to the printing unit.

By reducing the decurling force when the sheet is returned, excessive decurling is prevented. Therefore, the chance that, when the sheet is supplied again, the sheet comes into contact with a print head (or a sheet processing unit) after passing through the decurling unit can be reduced.

Further features of the present invention will become apparent from the following description of exemplary embodiments with reference to the attached drawings.

DESCRIPTION OF THE EMBODIMENTS

An embodiment of an ink-jet printing apparatus will be described. The printing apparatus of this embodiment is a high-speed line printer that uses a long continuous sheet (a continuous sheet longer than the length of a print unit (referred to as a page or a unit image) repeated in the conveying direction) and is capable of both simplex and duplex printing. This recording apparatus is suitable for the field of printing on a large number of sheets, for example, in a printing shop. In this specification, if small images, characters, and blanks are mixed in a print unit (a page), they are collectively referred to as a unit image. That is to say, a unit image means a print unit (a page) in the case where a plurality of pages are sequentially printed on a continuous sheet. The length of a unit image differs depending on the size of the image to be printed. For example, in the case of a large size photograph, the length in the sheet conveying direction is 135 mm, and in the case of A4 size, the length in the sheet conveying direction is 297 mm.

The present invention can be widely applied to printing apparatus, such as printers, multifunction printers, copying machines, facsimile machines, and apparatus for manufacturing various devices. Printing processing may be performed by any method such as an ink-jet method, an electrophotographic method, a thermal transfer method, a dot impact method, a liquid development method, and so on. The present invention can be applied not only to print processing but also to a sheet processing apparatus that performs various processing (recording, treatment, coating, irradiation, reading, inspection, and so on) on a rolled sheet.

Figure 1:
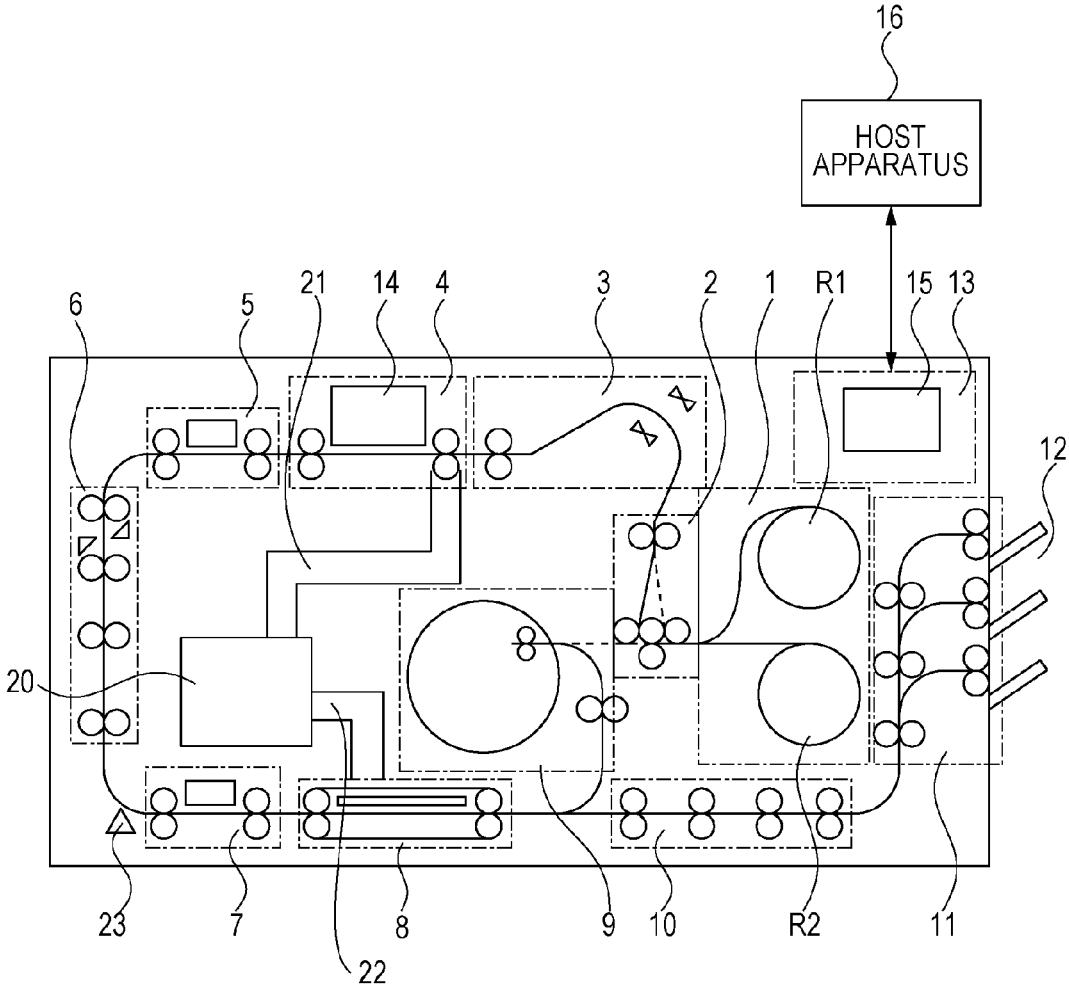
FIG. 1 is a schematic view showing the internal configuration of a printing apparatus.

FIG. 1 is a schematic sectional view showing the internal configuration of a printing apparatus. The printing apparatus of this embodiment uses a rolled sheet and can perform duplex printing on a side (first surface) and the other side (second surface) of the sheet. The printing apparatus mainly has a sheet feeding unit 1, a decurling unit 2, a skew correction unit 3, a printing unit 4, an inspection unit 5, a cutter unit 6, an information recording unit 7, a drying unit 8, a reverse unit 9, an ejection conveyance unit 10, a sorter unit 11, an ejecting unit 12, a humidification unit 20, and a control unit 13. A sheet is conveyed along a sheet conveying path shown by solid line in the figure by a conveying mechanism including roller pairs and belts and is processed in each unit. At any position on the sheet conveying path, the side closest to the sheet feeding unit 1 is referred to as "upstream," and the opposite side is referred to as "downstream."

The sheet feeding unit 1 holds and feeds a rolled continuous sheet. The sheet feeding unit 1 can house two rolls R1 and R2 and unrolls and feeds the roll R1 or R2. The number of rolls housed in the sheet feeding unit 1 is not limited to two. A single roll or three or more rolls may be housed in the sheet feeding unit 1.

The decurling unit 2 reduces the curl of a sheet fed from the sheet feeding unit 1. The decurling unit 2 bends the sheet passing therethrough in a predetermined direction, the opposite direction from the direction of curl, using a driving roller and two pinch rollers, thereby exerting decurling force on the sheet and reducing the curl. As described later, the decurling unit 2 can regulate the decurling force.

After the sheet passes through the decurling unit 2, the skew correction unit 3 corrects the skew (the inclination relative to the original direction of movement) of the sheet. By pressing a reference edge of the sheet against a guide member, the skew of the sheet is corrected.

The printing unit 4 performs print processing on the sheet being conveyed from above with a print head 14, thereby forming an image. That is to say, the printing unit 4 is a processing unit that performs predetermined processing on the sheet. The printing unit 4 also has a plurality of conveying rollers that convey the sheet. The print head 14 has a plurality of line-type print heads each having a line of ink-jet nozzles formed so as to cover the maximum recording width of sheets used with this apparatus. The plurality of print heads are arranged along the sheet conveying direction parallel to each other. In this embodiment, the print head 14 has seven print heads corresponding to seven colors of C (cyan), M (magenta), Y (yellow), LC (light cyan), LM (light magenta), G (gray), and K (black). The number of colors and the number of print heads are not limited to seven. An ink-jet technology using, for example, a heater element, a piezoelectric element, an electrostatic element, or a MEMS element can be used. Respective colors of ink are supplied from ink tanks through ink tubes to the print head 14. As described later, in the printing unit 4, the print head 14 can be moved so as to be retracted from the sheet. The distance between the sheet and the print head 14 is thereby regulated.

The inspection unit 5 optically reads an inspection pattern and an image printed on the sheet in the printing unit 4 with a scanner, inspects the state of the nozzles of the print heads, the state of conveying the sheet, and the position of the image, and determines whether the image is properly printed. The scanner has a CCD image sensor or a CMOS image sensor.

The cutter unit 6 has a mechanical cutter that cuts the sheet on which printing has been performed into pieces having a predetermined length. The cutter unit 6 also has a plurality of conveying rollers for sending the sheet to the next process.

The information recording unit 7 records print information (unique information), such as the serial number and date of printing, in the non-printing region of the cut sheet. The recording is performed by printing characters or a code by an ink-jet technology or a thermal transfer technology. A sensor 23 that detects the leading edge of the cut sheet is provided upstream of the information recording unit 7 and downstream of the cutter unit 6. That is to say, the sensor 23 detects the leading edge of the sheet between the cutter unit 6 and the recording position in the information recording unit 7. On the basis of the detection timing of the sensor 23, the timing of when the information recording unit 7 records information is controlled.

The drying unit 8 heats the sheet on which printing has been performed in the printing unit 4, and dries ink applied thereto in a short time. In the drying unit 8, hot air is blown to the sheet passing therethrough at least from below so as to dry the surface to which ink is applied. Drying may be performed not only by blowing hot air but also by irradiating the surface of the sheet with electromagnetic radiation (for example, ultraviolet or infrared).

The above-described sheet conveying path from the sheet feeding unit 1 to the drying unit 8 will be referred to as first path. The part of the first path from the printing unit 4 to the drying unit 8 has a U shape. The cutter unit 6 is located at the midpoint of the U shape.

When the duplex printing is performed, the reverse unit 9 temporarily winds the continuous sheet after printing on the first surface is completed, and reverses the sheet. The reverse unit 9 is provided at the midpoint of a path (loop path) (referred to as second path) from the drying unit 8 through the decurling unit 2 to the printing unit 4 for feeding the sheet that has passed through the drying unit 8 to the printing unit 4 again. The reverse unit 9 has a winding rotary member (drum) for winding the sheet. After printing on the first surface is completed, the uncut continuous sheet is temporarily wound by winding rotary member. After the winding is completed, the winding rotary member is reversed, and the wound sheet is fed to the decurling unit 2 and is then sent to the printing unit 4. Because this sheet is reversed, printing can be performed on the second surface in the printing unit 4. More detailed operation of duplex printing will be described later.

After being cut in the cutter unit 6 and dried in the drying unit 8, the sheet is conveyed by the ejection conveyance unit 10 to the sorter unit 11. The ejection conveyance unit 10 is provided on a path (referred to as third path) different from the second path on which the reverse unit 9 is provided. In order to lead the sheet that has been conveyed along the first path to the second path or the third path, a path switching mechanism having a movable flapper is provided at the branching position.

The sorter unit 11 and the ejecting unit 12 are provided beside the sheet feeding unit 1 and at the end of the third path. If necessary, the sorter unit 11 sorts the printed sheets into groups. The sorted sheets are ejected onto the ejection unit 12 including a plurality of trays. As described above, the third path passes under the sheet feeding unit 1 and ejects sheets on the opposite side of the sheet feeding unit 1 from the printing unit 4 and the drying unit 8.

As described above, the sheet feeding unit 1 to the drying unit 8 are provided in order on the first path. After passing through the drying unit 8, the first path is branched into the second path and the third path. The reverse unit 9 is provided at the midpoint of the second path. After passing through the reverse unit 9, the second path joins the first path. At the end of the third path is provided the ejecting unit 12.

The humidification unit 20 produces humidified gas (air) and supplies the humidified gas (air) to the space between the print head 14 of the printing unit 4 and the sheet. This prevents drying of ink in the nozzles of the print head 14. Examples of humidification methods used in the humidification unit 20 include vaporization method, water spray method, and steam method. Examples of vaporization methods include rotary method, which is used in this embodiment, moisture permeable film method, drop penetration method, and capillary method. Examples of water spray methods include ultrasonic method, centrifugal method, high-pressure spray method, and two-fluid spay method. Examples of steam methods include steam piping method, electrothermal method, and electrode method. The humidification unit 20 and the printing unit 4 are connected by a first duct 21. The humidification unit 20 and the drying unit 8 are connected by a second duct 22. In the drying unit 8, humid and hot gas is produced when the sheet is dried. This gas is introduced through the second duct 22 into the humidification unit 20 and is used as supplemental energy for producing humidified gas in the humidification unit 20. The humidified gas produced in the humidification unit 20 is introduced through the first duct 21 into the printing unit 4.

The control unit 13 controls each unit of the printing apparatus. The control unit 13 has a CPU, a storage device, a controller having various control sections, an external interface, and an operation unit 15 through which a user performs input and output. The operation of the printing apparatus is controlled by a command from the controller or a host apparatus 16, such as a host computer, connected to the controller through the external interface.

Figure 2:
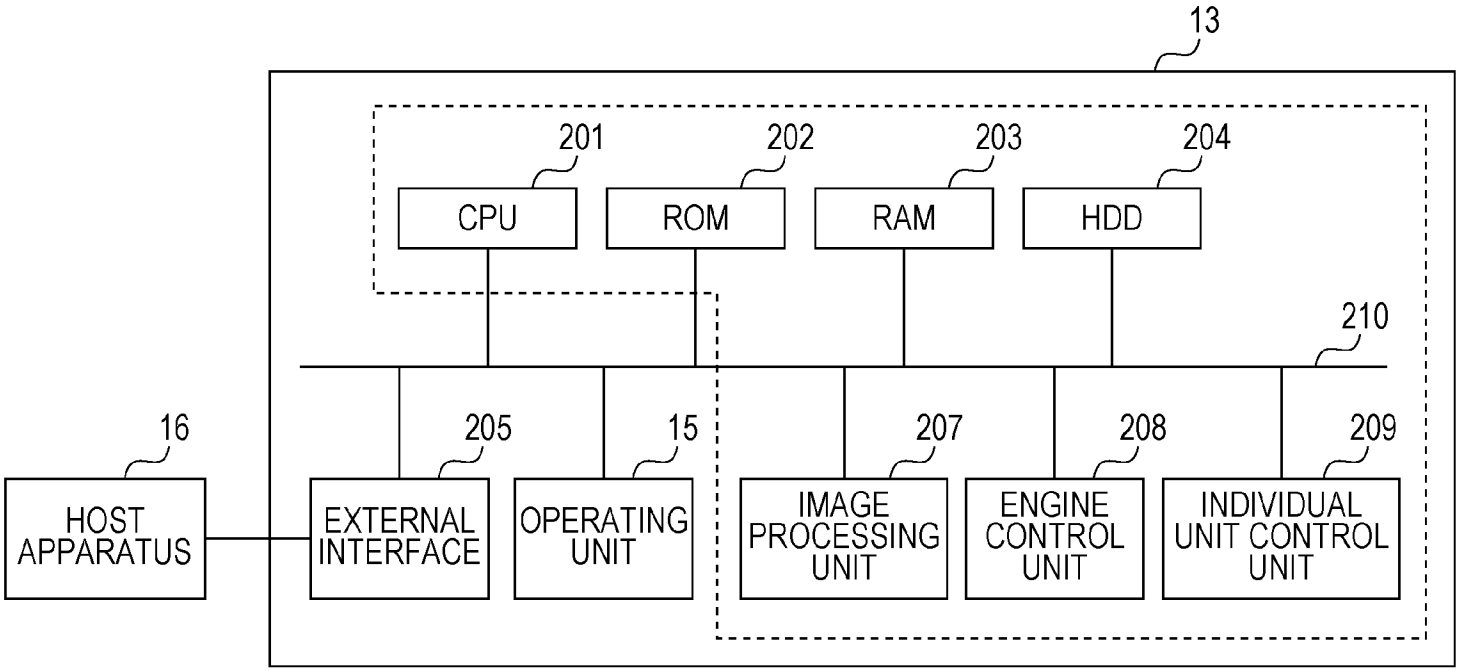
FIG. 2 is a block diagram of a control unit.

FIG. 2 is a block diagram showing the concept of the control unit 13. The controller (the region enclosed by a dashed line) of the control unit 13 includes a CPU 201, a ROM 202, a RAM 203, a HDD 204, an image processing unit 207, an engine control unit 208, and an individual unit control unit 209. The CPU 201 (central processing unit) integrally controls the operation of each unit of the printing apparatus. The ROM 202 stores programs that the CPU 201 executes and fixed data necessary for various operation of the printing apparatus. The RAM 203 is used as a work area of the CPU 201, is used as a temporary storage area for various received data, and stores various setting data. The HDD 204 can store programs that the CPU 201 executes, print data, and setting information necessary for various operation of the printing apparatus. The operation unit 15 is a user input/output interface and includes an input unit, such as hard keys or a touch panel, and an output unit that presents information, such as a display or a sound generator.

Units requiring high-speed data processing are provided with dedicated processors. The image processing unit 207 performs image processing of print data handled by the printing apparatus. The image processing unit 207 converts the color space (for example, YCbCr) of input image data into a standard RGB color space (for example, sRGB). Various image processing, such as resolution conversion, image analysis, image correction, and so on, is performed on the image data if necessary. Print data obtained through the image processing are stored in the RAM 203 or the HDD 204. The engine control unit 208 performs drive control of the print head 14 of the printing unit 4 according to the print data by a control command received, for example, from the CPU 201. The engine control unit 208 also controls the conveying mechanism of each unit of the printing apparatus. The individual unit control unit 209 is a sub-controller for individually controlling the sheet feeding unit 1, the decurling unit 2, the skew correction unit 3, the inspection unit 5, the cutter unit 6, the information recording unit 7, the drying unit 8, the reverse unit 9, the ejection conveyance unit 10, the sorter unit 11, the ejecting unit 12, and the humidification unit 20. By a command from the CPU 201, the operation of each unit is controlled by the individual unit control unit 209. The external interface 205 is an interface for connecting the controller to the host apparatus 16 and is a local interface or a network interface. The above-described components are connected by a system bus 210.

The host apparatus 16 serves as a supply source of image data for causing the printing apparatus to perform printing. The host apparatus 16 may be a general-purpose or dedicated computer, or a dedicated image device, such as an image capture device having an image reader unit, a digital camera, or a photo storage. In the case where the host apparatus 16 is a computer, an OS, application software that generates image data, and a printing apparatus driver for the printing apparatus are installed into a storage unit of the computer. Not all the above-described processing necessarily have to be performed by software. Some or all of them may be performed by hardware.

Next, basic operation during printing will be described. The operation in the simplex printing mode differs from the operation in the duplex printing mode, so they will be described separately.

Figure 3:
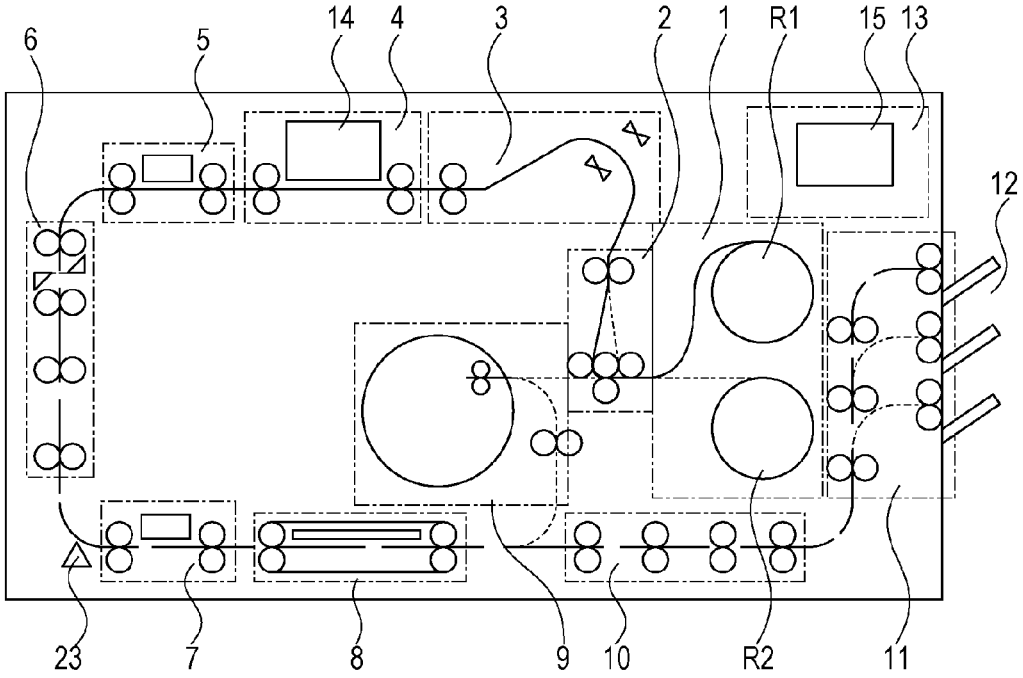
FIG. 3 illustrates the operation in the simplex printing mode.

FIG. 3 illustrates the operation in the simplex printing mode. A conveying path along which the sheet fed from the sheet feeding unit 1 undergoes printing and is ejected onto the ejecting unit 12 is shown by a heavy line. After the sheet is fed from the sheet feeding unit 1 and processed in the decurling unit 2 and the skew correction unit 3, printing is performed on a side (first surface) of the sheet in the printing unit 4. A plurality of images (unit images) each having a predetermined unit length in the conveying direction are printed sequentially on the long continuous sheet. After undergoing printing, the sheet passes through the inspection unit 5 and is then cut into each unit image in the cutter unit 6. If necessary, print information is recorded on the reverse side of the cut sheets in the information recording unit 7. The cut sheets are conveyed one at a time to the drying unit 8, where drying is performed. After that, passing through the ejection conveyance unit 10, the sheets are sequentially ejected onto the ejecting unit 12 of the sorter unit 11. On the other hand, the sheet left on the printing unit 4 side by cutting the last unit image is returned to the sheet feeding unit 1 and is wound by the roll R1 or R2. As described later, at the time of this return, the decurling force in the decurling unit 2 is regulated so as to be small, and the print head 14 is retracted from the sheet.

As described above, in the simplex printing, the sheet passes through the first path and the third path and is processed, and does not pass through the second path. To sum up, in the simplex printing mode, the following sequences (1) to (6) are performed by the control of the control unit 13.

(1) The sheet feeding unit 1 feeds the sheet to the printing unit 4;

(2) The printing unit 4 repeats printing of a unit image on a first surface of the fed sheet;

(3) The cutter unit 6 cuts the sheet every time a unit image printed on the first surface passes through the cutter unit 6;

(4) The cut sheets are caused to pass through the drying unit 8 one at a time;

(5) After passing through the drying unit 8 one at a time, the sheets are ejected through the third path onto the ejecting unit 12; and (6) The sheet left on the printing unit 4 side by cutting the last unit image is returned to the sheet feeding unit 1.

Figure 4:
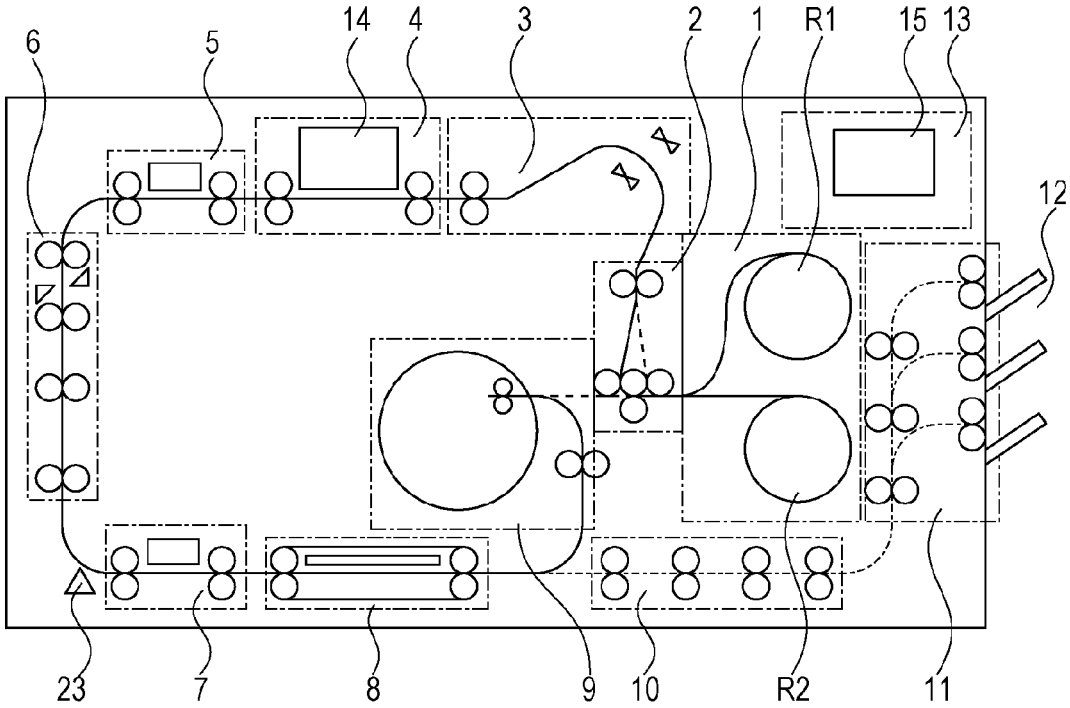
FIG. 4 illustrates the operation in the duplex printing mode.

FIG. 4 illustrates the operation in the duplex printing mode. In the duplex printing, following a first surface printing sequence, a reverse side (second surface) printing sequence is performed. In the first surface printing sequence, the operations in the sheet feeding unit 1 to the inspection unit 5 are the same as those in the simplex printing described above. Without being cut in the cutter unit 6, the continuous sheet is conveyed to the drying unit 8. After the ink on the first surface of the sheet is dried, the sheet is led not to the ejection conveyance unit 10 side path (third path) but to the reverse unit 9 side path (second path). In the second path, the sheet is wound by a winding rotary member of the reverse unit 9 that rotates in the forward direction (counterclockwise in the figure). After the printing on the first surface is completed in the printing unit 4, the continuous sheet is cut along the trailing edge of the print region in the cutter unit 6. The continuous sheet on the downstream side in the conveying direction of the cut position (the continuous sheet on which printing has been performed) passes through the drying unit 8 and is then completely wound in the reverse unit 9. At the same time as the winding in the reverse unit 9, the continuous sheet left upstream of the cut position (on the printing unit 4 side) is returned to the sheet feeding unit 1 and is wound by the roll R1 or R2 so that the cut edge of the sheet is not left in the decurling unit 2. By this return (backward feed), the sheet is prevented from colliding with the sheet fed again in the following second surface printing sequence. As described later, at the time of this return, the decurling force in the decurling unit 2 is regulated so as to be small, and the print head 14 is retracted from the sheet. After the above-described first surface printing sequence, switching is performed to the second surface printing sequence. The winding rotary member of the reverse unit 9 rotates in the opposite direction from that during the winding (clockwise in the figure). The edge of the wound sheet (the trailing edge of the sheet during the winding is the leading edge of the sheet during the feeding) is introduced into the decurling unit 2 along the path shown by a dashed line in the figure. In the decurling unit 2, the curl caused by the winding rotary member is corrected. That is to say, the decurling unit 2 is provided between the sheet feeding unit 1 and the printing unit 4 in the first path, and between the reverse unit 9 and the printing unit 4 in the second path, and performs decurling in both paths. The reversed sheet is sent through the skew correction unit 3 to the printing unit 4, where printing is performed on the second surface of the sheet. After the printing on the second surface, the sheet passes through the inspection unit 5 and is then cut in a predetermined unit length in the cutter unit 6. Because printing is performed on both sides of the cut sheets, recording in the information recording unit 7 is not performed. The cut sheets are conveyed to the drying unit 8 one at a time, pass through the ejection conveyance unit 10, and are sequentially ejected and stacked on the ejection unit 12 of the sorter unit 11.

As described above, in the duplex printing, the sheet passes through the first path, the second path, the first path, and the third path in order and is processed. To sum up, in the duplex printing mode, the following sequences (1) to (11) are performed by the control of the control unit 13.

(1) The sheet feeding unit 1 feeds the sheet to the printing unit 4;

(2) The printing unit 4 repeats printing of a unit image on a first surface of the fed sheet;

(3) After the printing on the first surface, the sheet is caused to pass through the drying unit 8;

(4) After passing through the drying unit 8, the sheet is led to the second path and wound by the winding rotary member of the reverse unit 9;

(5) After the repeated printing on the first surface is completed, the sheet is cut along the trailing edge of the last-printed unit image in the cutter unit 6;

(6) The cut sheet is wound by the winding rotary member until the trailing edge of the cut sheet passes through the drying unit 8 and reaches the winding rotary member. At the same time, the sheet left on the printing unit 4 side is returned to the sheet feeding unit 1;

(7) After the winding is completed, the winding rotary member is reversed, and the sheet is fed through the second path to the printing unit 4 again;

(8) The printing unit 4 repeats printing of a unit image on the second surface of the sheet fed through the second path;

(9) The cutter unit 6 cuts the sheet every time a unit image printed on the second surface passes through the cutter unit 6;

(10) The cut sheets are caused to pass through the drying unit 8 one at a time; and

(11) After passing through the drying unit 8 one at a time, the sheets are ejected through the third path onto the ejecting unit 12.

Figure 6A:
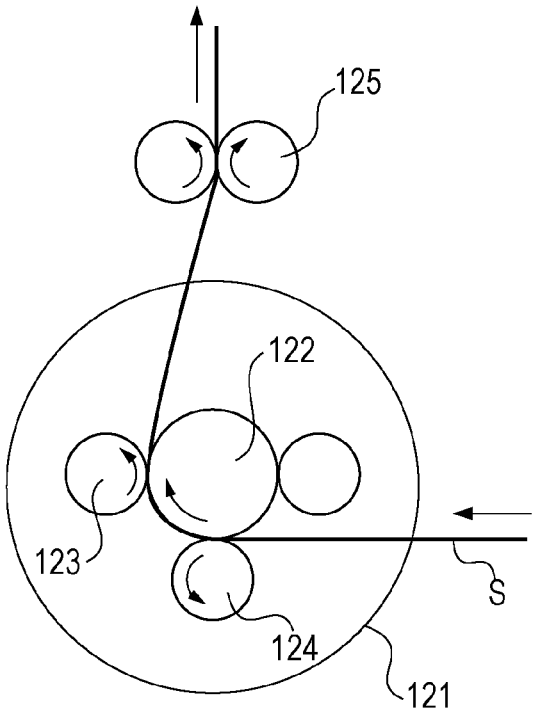
FIGS. 6A and 6B illustrate the configuration and operation of a decurling unit.
Figure 6B:
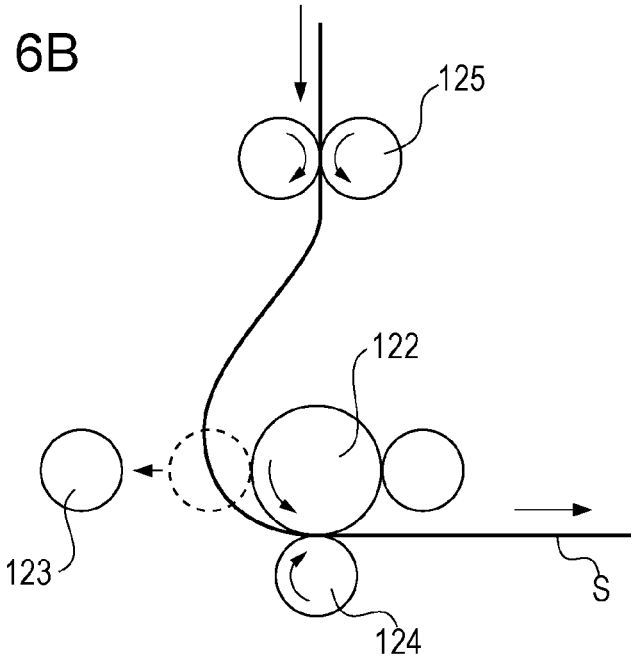

FIGS. 6A and 6B illustrate the configuration and operation of the decurling unit 2. The decurling unit 2 exerts decurling force in a predetermined direction on the sheet fed from the sheet feeding unit 1 and reduces the curl. In FIG. 6A, the decurling unit 2 includes a decurling roller unit 121 and a conveying roller pair 125. The decurling roller unit 121 includes a driving roller 122 to which rotational driving force is given and pinch rollers 123 and 124 driven by the driving roller 122. The pinch roller 123 can move into and out of contact with the driving roller 122. The pinch roller 124 is always in contact with the driving roller 122. FIG. 6A shows a state where the pinch roller 123 is in contact with the driving roller 122 with the sheet S therebetween. The sheet S is pressed against the driving roller 122 by both the pinch rollers 123 and 124 and curves along the periphery of the driving roller 122, and the curvature radius of the sheet S is relatively small. In this state, relatively large decurling force in a predetermined direction acts on the sheet S. FIG. 6B shows a state where the pinch roller 123 is out of contact with the driving roller 122. The sheet S is pressed against the driving roller 122 only by the pinch roller 124. The sheet S is supported at two positions: the nip position of the conveying roller pair 125 and the nip position between the driving roller 122 and the pinch roller 124. At the position corresponding to the pinch roller 123, the sheet S bulges outward, and the curvature radius of the sheet S is larger than that in the state of FIG. 6A. Therefore, decurling force smaller than that in the state of FIG. 6A acts on the sheet S in a predetermined direction. As described above, the decurling unit 2 has a driving roller 122 and a plurality of pinch rollers at least one (the pinch roller 123) of which can move into and out of contact with the driving roller 122. By moving the pinch roller 123 into and out of contact with the driving roller 122, the curvature of the sheet at the driving roller is changed, and the decurling force is regulated.

Figure 7:
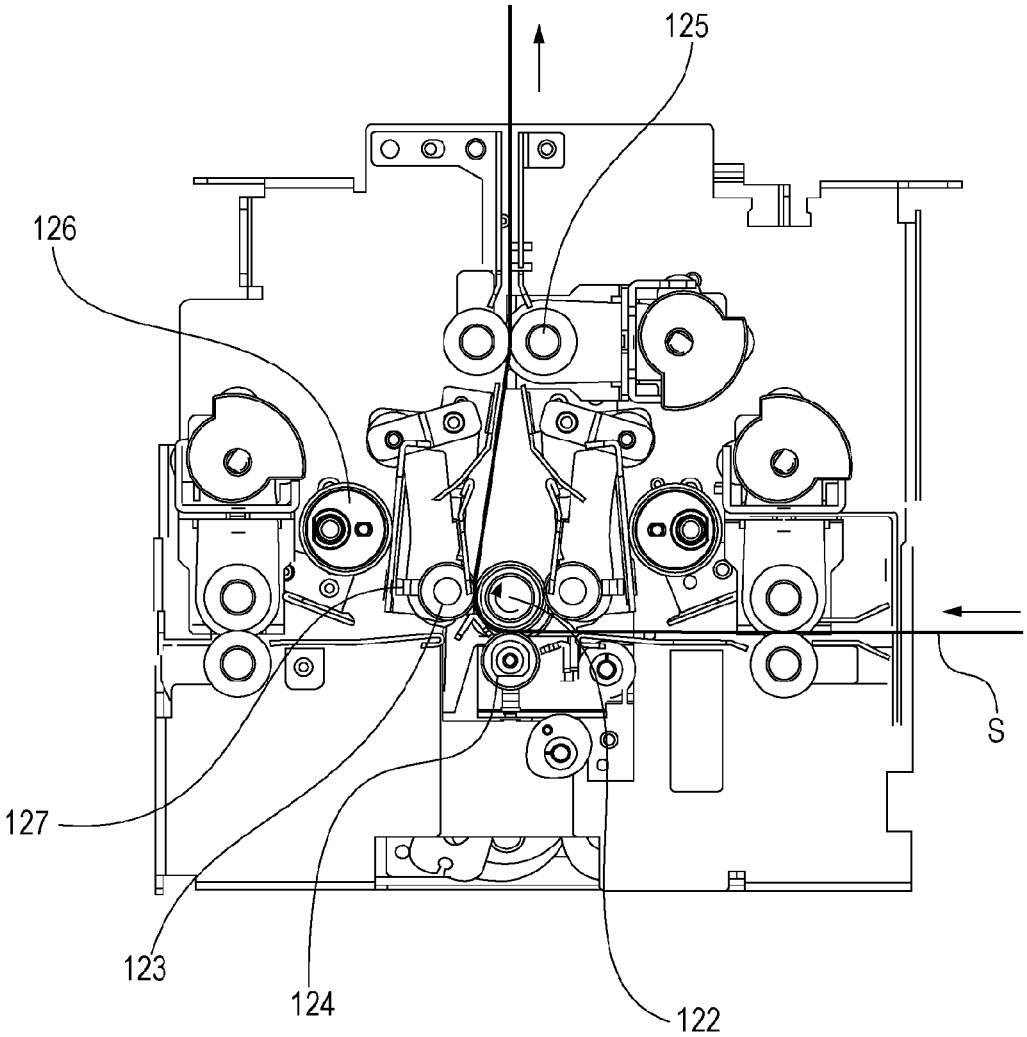
FIG. 7 shows the detailed structure of a pinch roller moving mechanism of the decurling unit.
Figure 8:
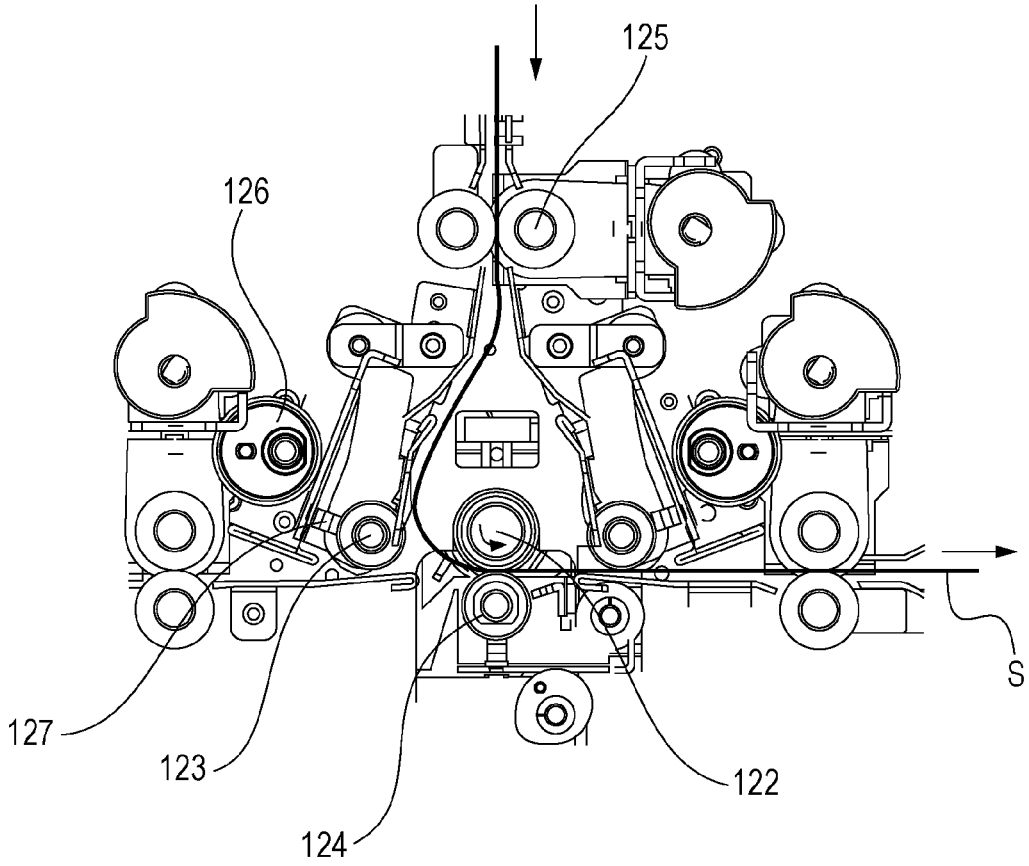
FIG. 8 shows the detailed structure of the pinch roller moving mechanism of the decurling unit.

FIG. 7 shows the detailed structure of a moving mechanism that moves the pinch roller 123 of the decurling unit 2. FIG. 7 shows a state where the pinch roller 123 is in contact with the driving roller 122. FIG. 8 shows a state where the pinch roller 123 is out of contact with and retracted from the driving roller 122. The moving mechanism has a cam 126 and a pressing spring 127. By rotationally driving the cam 126, the pinch roller 123 is switched between the contact position and the out-of-contact position.

Figure 9A:
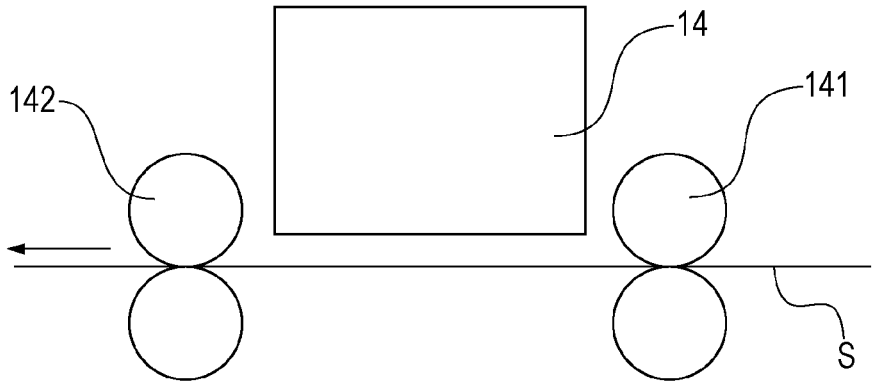
FIGS. 9A and 9B illustrate the raising and lowering of a print head.
Figure 9B:
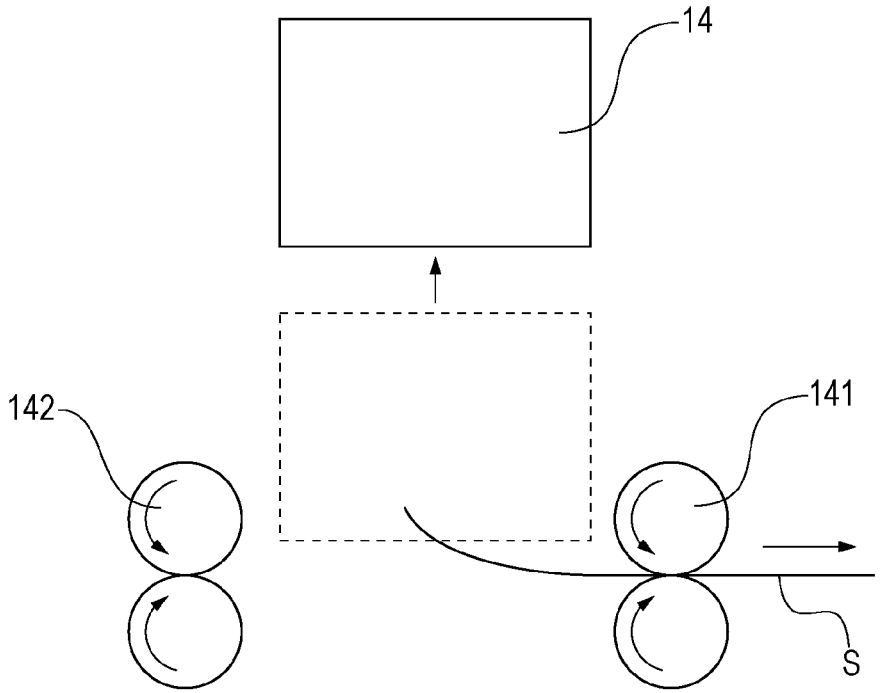

FIGS. 9A and 9B illustrate the configuration and operation of the printing unit 4. In FIG. 9A, the printing unit 4 includes an upstream conveying roller pair 141, a downstream conveying roller pair 142, and a print head 14 therebetween. The sheet S is nipped and conveyed by the conveying roller pairs 141 and 142. The print head 14 can be moved so as to be retracted from the sheet S, and the distance between the sheet S and the print head 14 is regulated. FIG. 9A shows a state where the print head 14 is located at a normal position. FIG. 9B shows a state where the print head 14 is out of the normal position.

Figure 10:
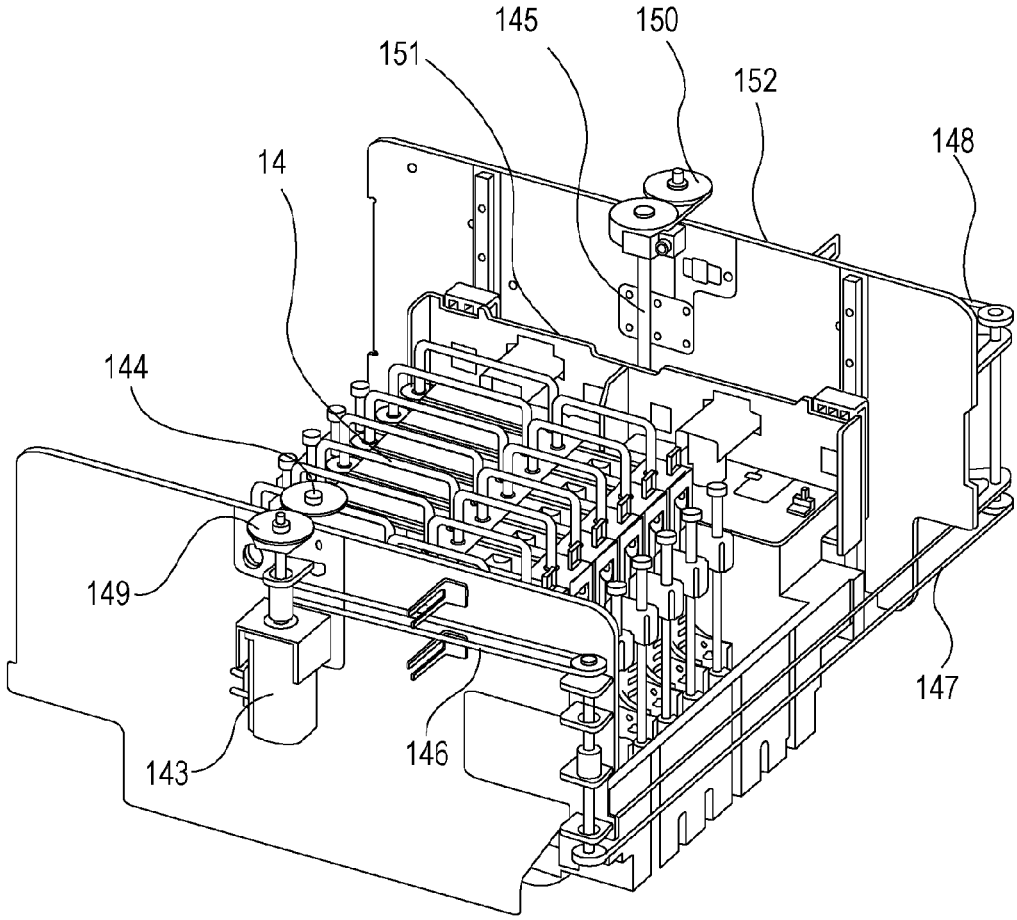
FIG. 10 is an overall perspective view showing the detailed structure of a print head elevating mechanism.
Figure 11:
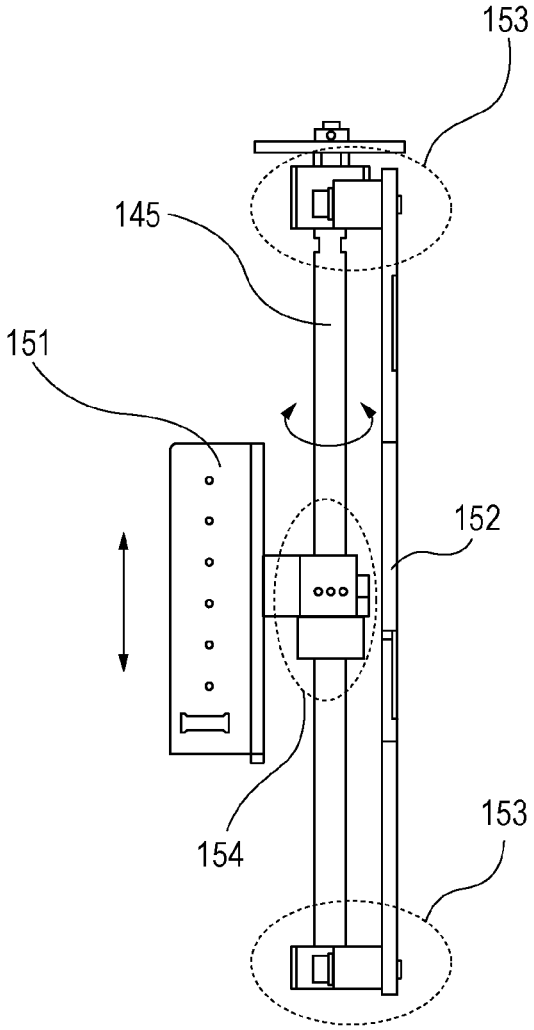
FIG. 11 shows the detailed structure of an elevating shaft of the elevating mechanism.

FIG. 10 is an overall perspective view showing the detailed structure of a mechanism that raises and lowers the print head 14. The print head 14 is housed in a case 151. By moving the case 151 up and down relative to a case 152 fixed to the frame of the printing apparatus, the print head 14 is moved up and down relative to the sheet. The up-and-down movement is performed by two elevating shafts 144 and 145. A motor 143 and a gear 149 rotate the elevating shaft 144. Belts 146, 147, and 148 and a gear 150 rotate the elevating shaft 145 in conjunction with the elevating shaft 144. FIG. 11 shows the detailed configuration of the elevating shaft 145. The elevating shaft 145 is fixed to the case 152 by fixing units 153. A moving unit 154 is engaged with the elevating shaft 145 by a ball screw mechanism. The moving unit 154 is connected to the case 151 of the print head 14. The elevating shaft 144 has the same configuration. When the elevating shafts 144 and 145 rotate, the ball screw mechanism linearly moves the movable unit 154 in the axial direction of the shaft, and the case 151, i.e., the print head 14 moves up and down.

Figure 12:
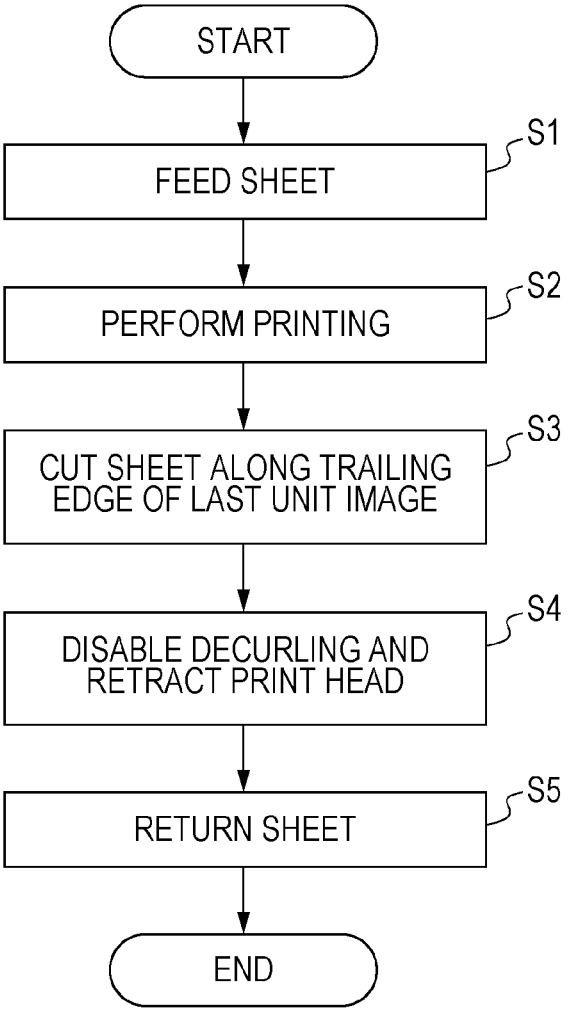
FIG. 12 is a flowchart showing the sequence until the return of the sheet.

Next, a more detailed description will be given of the operation to return the sheet left on the upstream side after the cutting of the sheet to the sheet feeding unit 1. FIG. 12 is a flowchart showing the sequence from the start of printing to the return of the sheet. As describe above, in both the simplex printing mode and the duplex printing mode, the cut sheet is returned after the printing on the first surface of the sheet.

Figure 5:
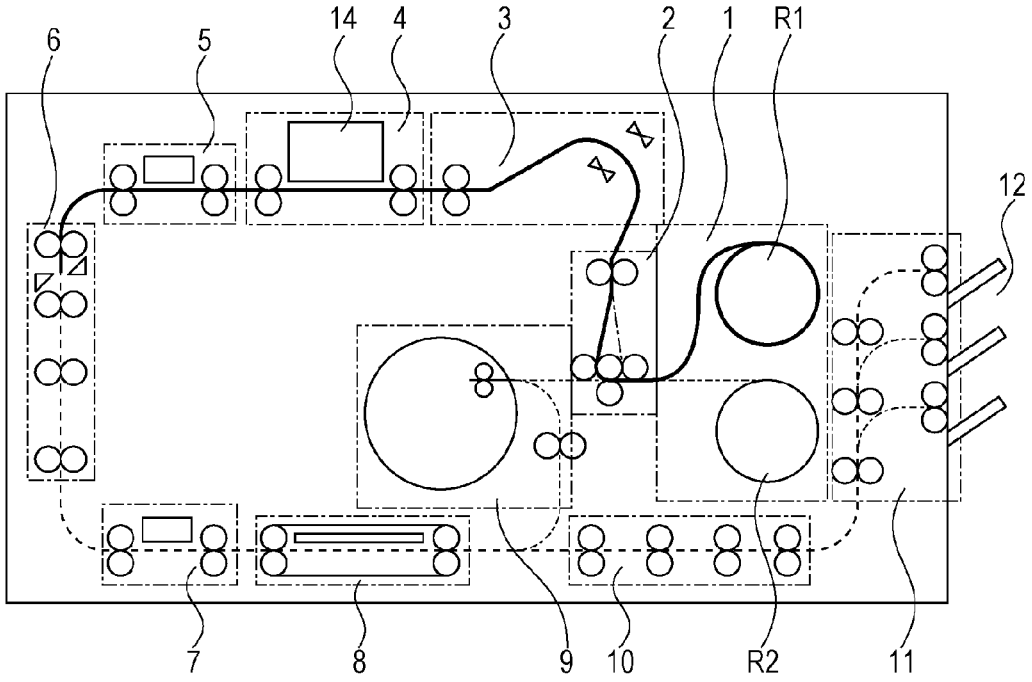
FIG. 5 shows a state just before the return of a cut sheet is started.

By a command to start printing operation, the sheet is fed from the sheet feeding unit 1 (step S1). Printing is performed on the fed sheet in the printing unit 4 (step S2). After the printing of a plurality of unit images on the first surface of the sheet is completed, the sheet is cut in the head holder 6 along the trailing edge of the last unit image (step S3). At the same time as the cutting of the sheet, the print head 14 is retracted from the sheet, and decurling is disabled in the decurling unit 2 (step S4). After that, the sheet is returned to the sheet feeding unit 1 and wound by the roll (step S5). FIG. 5 shows a state after the sheet is cut and just before the return is started. The sheet S being returned is shown by a heavy line. In this example, the sheet is wound by the roll R1. In the case of simplex printing mode, the printing operation is completed. In the case where printing is performed again, the same sequence is performed from step S1. In the case of duplex printing mode, printing on the second surface is subsequently performed.

As described above, the decurling unit 2 can regulate the decurling force. When the sheet is fed from the sheet feeding unit 1 (steps S1 and S2), the decurling unit 2 is in a state shown in FIG. 6A. On the other hand, when the sheet is returned from the printing unit 4 to the sheet feeding unit 1 (step S5), the decurling unit 2 is in a state shown in FIG. 6B. That is to say, the decurling force is regulated so as to be smaller when the sheet is returned from the printing unit 4 to the sheet feeding unit 1 than when the sheet is fed from the sheet feeding unit 1 to the printing unit 4. By reducing the decurling force when the sheet is returned, excessive decurling is prevented. Therefore, the chance that, when the rolled sheet is fed again, the sheet comes into contact with the print head after passing through the decurling unit can be reduced. Therefore, unexpected ink is prevented from adhering to the sheet, and the print head and the sheet are prevented from being damaged.

As described above, the printing unit 4 can regulate the distance between the sheet and the print head. When the sheet is fed from the sheet feeding unit 1 (steps S1 and S2), the print head 14 is in a state shown in FIG. 9A. On the other hand, when the sheet is returned from the printing unit 4 to the sheet feeding unit 1 (step S5), the print head 14 is in a state shown in FIG. 9B. That is to say, the distance between the print head 14 and the sheet is regulated so as to be larger when the sheet is returned from the printing unit 4 to the sheet feeding unit 1 than when the sheet is fed from the sheet feeding unit 1 to the printing unit 4. Therefore, the chance that, when the cut sheet is returned, and especially when the trailing edge of the cut sheet passes under the print head 14 as shown in FIG. 9B, the sheet comes into contact with the print head 14 can be reduced. In the state of FIG. 9B, the trailing edge of the sheet curves upward. It can be seen that because the print head 14 is retracted above the normal position, the print head 14 is prevented from coming into contact with the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042341 filed Feb. 26, 2010, which is hereby incorporated by reference herein in its entirety.

What is claimed is:

1. An apparatus comprising:

a sheet feeding unit configured to feed a sheet which is continuous and held as a roll;

a decurling unit configured to exert a decurling force on the sheet fed from the sheet feeding unit to reduce a curl of the fed sheet;

a skew correction unit configured to correct skew of the sheet passed through the decurling unit;

a printing unit located downstream of the skew correction unit, configured to perform printing on the sheet passed through the skew correction unit;

a cutter unit located downstream of the printing unit, configured to cut the sheet; and a storing unit configured to store the sheet for duplex printing, wherein, in the duplex printing, the sheet is fed from the storing unit toward the printing unit through the decurling unit and the skew correction unit, the sheet printed on a first surface by the printing unit is stored in the storing unit and cut by the cutter unit, then the sheet is fed from the storing unit toward the printing unit through the decurling unit and the skew correction unit, then the sheet is printed by the printing unit on a second surface, and the sheet cut by the cutter unit and left on a printing unit side is returned to the sheet feeding unit through the skew correction unit and the decurling unit, before the storing unit starts feeding, the decurling force when the sheet is returned from the printing unit to the sheet feeding unit is reduced from when the sheet is fed from the sheet feeding unit to the printing unit.

2. The apparatus according to claim 1, wherein the printing unit includes a print head, and wherein the control unit controls the printing unit such that a distance between the print head and the sheet is regulated to be larger when the cut sheet is returned from the printing unit to the sheet feeding unit than when the sheet is fed from the sheet feeding unit to the printing unit.

3. The apparatus according to claim 1, wherein, in simplex printing, (1) the sheet feeding unit feeds a continuous sheet to the printing unit through the decurling unit, and the skew correction unit, (2) the printing unit prints a plurality of images sequentially on the fed sheet, (3) the cutter unit cuts the printed sheet into pieces each having the image printed thereon, and (4) the sheet, left on the printing unit side by cutting a last printed image, is returned to the sheet feeding unit; through the skew correction unit and the decurling unit.

4. The apparatus according to claim 1, wherein, (1) the sheet feeding unit feeds the sheet to the printing unit through the decurling unit, and the skew correction unit;

(2) the printing unit prints a plurality of images sequentially on a first surface of the sheet fed from the sheet feeding unit, (3) after the printing on the first surface is completed, the cutter unit cuts the sheet at a position corresponding to a last printed image, (4) the cut sheet, left on the printing unit side, is returned to the sheet feeding unit, through the skew correction unit and the decurling unit;

(5) the sheet printed on the first surface is led to the reverse unit, and the reversed sheet is fed to the printing unit again, through the decurling unit and the skew correction unit;

(6) the printing unit prints a plurality of images sequentially on a second surface, which is a back of the first surface, of the sheet fed from the reverse unit, and (7) the cutter unit cuts the sheet printed on the second surface into pieces each having the image printed thereon.

5. The apparatus according to claim 4, wherein the reverse unit includes a winding rotary member, and wherein the sheet printed on the first surface is temporarily wound around the winding rotary member, and subsequently, the winding rotary member rotates in reverse to feed the wound sheet to the printing unit.

6. The apparatus according to claim 1, wherein the decurling unit includes a driving roller, and a plurality of pinch rollers, at least one of which can be moved into and out of contact with the driving roller, and wherein a curvature of the sheet at the driving roller is changed by moving the at least one pinch roller into and out of contact with the driving roller, whereby the decurling force is regulated.

7. The apparatus according to claim 1, wherein the control unit further controls the decurling unit so that a leading edge of the returned sheet returned from the printing unit is less likely to come into contact with a print head of the printing unit when the returned sheet is again fed from the sheet feeding unit to the printing unit through the decurling unit.

8. An apparatus comprising:

a sheet feeding unit configured to feed a sheet which is continuous;

a decurling unit configured to exert a decurling force on the sheet fed from the sheet feeding unit to reduce a curl of the fed sheet;

a skew correction unit configured to correct skew of the sheet passed through the decurling unit;

a processing unit located downstream of the skew correction unit, configured to perform a predetermined processing on the sheet passed through the skew correction unit;

a cutter unit located downstream of the processing unit, configured to cut the sheet, and a storing unit configured to store the sheet for duplex processing, wherein, in the duplex processing, the sheet is fed from the storing unit toward the processing unit through the decurling unit and the skew correction unit, the sheet processed on a first surface by the processing unit is stored in the storing unit and cut by the cutter unit, then the sheet is fed from the storing unit toward the processing unit through the decurling unit and the skew correction unit, then the sheet is processed by the processing unit on a second surface, and the sheet cut by the cutter unit and left on a processing unit side is returned to the sheet feeding unit through the skew correction unit and the decurling unit, before storing unit starts feeding, wherein the decurling force when the sheet is returned from the processing unit to the sheet feeding unit is reduced from when the sheet is fed from the sheet feeding unit to the processing unit.

9. The apparatus according to claim 8, wherein the control unit further controls the decurling unit so that a leading edge of the returned sheet returned from the printing unit is less likely to come into contact with a print head of the printing unit when the returned sheet is again fed from the sheet feeding unit to the printing unit through the decurling unit.

* * * * *